US010065232B2

(12) United States Patent
Arthur et al.

(10) Patent No.: US 10,065,232 B2
(45) Date of Patent: Sep. 4, 2018

(54) DEVICES AND METHODS FOR BENDING A TAB ON A CONTAINER

(71) Applicant: Station 4 LLC, Loveland, CO (US)

(72) Inventors: Matthew Lee Arthur, Loveland, CO (US); Leia Barnwell, Loveland, CO (US)

(73) Assignee: Station 4 LLC, Loveland, CO (US)

( * ) Notice: Subject to any disclaimer, the term of this patent is extended or adjusted under 35 U.S.C. 154(b) by 197 days.

(21) Appl. No.: 14/774,063

(22) PCT Filed: Mar. 12, 2014

(86) PCT No.: PCT/US2014/024033

§ 371 (c)(1),
(2) Date: Sep. 9, 2015

(87) PCT Pub. No.: WO2014/150705

PCT Pub. Date: Sep. 25, 2014

(65) Prior Publication Data

US 2016/0038992 A1 Feb. 11, 2016

Related U.S. Application Data

(60) Provisional application No. 61/788,594, filed on Mar. 15, 2013.

(51) Int. Cl.
*B21D 51/38* (2006.01)
*B21D 11/10* (2006.01)
(Continued)

(52) U.S. Cl.
CPC ..... *B21D 51/383* (2013.01); *B21D 11/10* (2013.01); *B65B 61/18* (2013.01); *B65B 61/24* (2013.01);
(Continued)

(58) Field of Classification Search
CPC ..... B21D 51/383; B21D 11/10; B21D 19/08; B21D 51/34; B21D 51/38; B21D 11/22;
(Continued)

(56) References Cited

U.S. PATENT DOCUMENTS 1,212,209 A * 1/1917 Gruver ..... B65B 7/285 53/330
2,085,879 A * 7/1937 Trump ..... B67B 3/14 53/330
(Continued)

FOREIGN PATENT DOCUMENTS

CN 2633786 Y 8/2004
JP 3148454 A 6/1991

OTHER PUBLICATIONS

Definition of Bearing by Merriam-Webster.com; Aug. 21, 2017.*
(Continued)

*Primary Examiner* — Shelley Self
*Assistant Examiner* — Mohammad Yusuf
(74) *Attorney, Agent, or Firm* — Coats & Bennett, PLLC

(57) ABSTRACT

A device to bend a tab on a container that is already filled and sealed. The device includes a brace for contacting against the tab and a number of lever arms arranged to extend around the tab from multiple different sides. The lever arms are configured to move between a first orientation that are spaced away from the tab, and a second orientation in contact with the tab. The lever arms are further configured to apply a force to the end of the tab to bend a second end upward away from a top side of the container.

14 Claims, 8 Drawing Sheets

(51) Int. Cl.
*B67B 7/40* (2006.01)
*B65D 43/26* (2006.01)
*B65B 61/18* (2006.01)
*B65B 61/24* (2006.01)

(52) U.S. Cl.
CPC ..... *B65D 43/265* (2013.01); *B67B 7/403* (2013.01); *B21D 51/38* (2013.01)

(58) Field of Classification Search
CPC B21D 11/12; B67B 7/00; B67B 7/403; B67B 7/14; B67B 7/15; B65D 43/265
USPC ..... 53/330
See application file for complete search history.

(56) References Cited

U.S. PATENT DOCUMENTS 2,204,594 A * 6/1940 Hogg ..... B67B 1/10 53/330
2,213,971 A * 9/1940 Gar Vaughn ..... B67B 3/14 413/38
2,501,204 A 3/1950 Boucher
2,757,561 A 8/1956 Lamer
2,840,134 A 6/1958 Rayburn et al.
2,958,170 A * 11/1960 Mayer, Jr. ..... B65B 31/003 53/330
2,975,575 A * 3/1961 Nalbach ..... B65B 7/285 53/330
3,121,447 A 2/1964 Zoschg
3,618,429 A * 11/1971 Froeliger ..... B67B 7/14 29/426.4
3,757,717 A * 9/1973 Bennett ..... B21D 51/34 29/512
3,910,212 A * 10/1975 Konoki ..... B21D 51/34 413/27
3,961,463 A * 6/1976 Dimond ..... B67B 1/04 53/306
4,412,464 A 11/1983 Cook
4,582,213 A 4/1986 Park et al.
4,597,280 A * 7/1986 Marti ..... B21D 51/34 413/56
4,672,836 A * 6/1987 Wilkinson ..... B25B 27/14 72/458
4,708,033 A 11/1987 Eash
4,719,824 A * 1/1988 Chagoya ..... B67B 7/403 220/274
4,774,859 A 10/1988 Jarvis, Sr.
4,873,896 A 10/1989 Hull
4,944,177 A 7/1990 Womack
5,411,159 A 5/1995 Fan
5,820,326 A 10/1998 Melson
5,931,059 A 8/1999 Hammer
6,619,100 B2 9/2003 Berg et al.
6,709,125 B2 3/2004 Jarvis
7,013,757 B2 3/2006 Saviano et al.
8,127,588 B1 3/2012 Halpin et al.
8,453,488 B2 6/2013 Xu
8,454,292 B2 6/2013 Saucedo et al.
8,490,460 B1 7/2013 Halpin et al.
8,935,947 B2 1/2015 Yoo
8,939,306 B2 1/2015 Rios
8,939,308 B2 1/2015 Ramsey et al.
8,939,317 B2 1/2015 Roeterdink
8,950,619 B2 2/2015 Bork
8,960,472 B2 2/2015 Tomaru et al.
8,960,487 B1 2/2015 Parke
8,966,865 B2 3/2015 Widitora et al.
8,967,409 B2 3/2015 Desiles et al.
8,967,411 B2 3/2015 Ferreira et al.
8,973,777 B2 3/2015 Ramsey et al.
8,973,780 B2 3/2015 Forrest et al.
2016/0332857 A1* 11/2016 Warren ..... B67B 7/15

OTHER PUBLICATIONS

International search report, International application No. PCT/US2014/024033. dated Jul. 21, 2014.
"ME 4182 Mechanical Design Engineering. Final Report Beverage Can Opener" Apr. 26, 2000. Finite Design, Inc. Viewed online at http://helix.gatech.edu/classes/me4182/2000S1/Webs/finitedesign/FinalReport/4182FinalReport.
CN Search Report dated Jun. 16, 2016 in re CN Application No. 201480027166.0 filed Nov. 12, 2015.

* cited by examiner

DEVICES AND METHODS FOR BENDING A TAB ON A CONTAINER

RELATED APPLICATIONS

The present application claims benefit of U.S. Application No. 61/788,594 filed on Mar. 15, 2013 entitled "Devices and Methods for Bending a Tab on a Container".

BACKGROUND

Containers are used for storing a variety of products, such as beverages, food items, and consumer and industrial products. The containers include an exterior that extends around a sealed interior space. A tab is mounted on the container to provide a user with a manner of opening the container and gaining access to the product in the sealed interior space.

FIG. 1 illustrates an embodiment of such a container. This embodiment is particularly applicable for storing beer or soda. The container 90 includes a cylindrical shape with a sidewall 95 and a top side 91. A tab 100 is connected to the top side 91 by a connector 109. A portion of the tab extends over a punch-out 94 that is sealed across a scored opening 97. To open the container, the user lifts up on a first end 101 of the tab 100 that is positioned away from the opening 97. This force pivots the tab 100 about the connector 109 and applies a force to the punch-out 94 through the second end 102. This force breaks the punch-out 94 from the opening 97 thus providing access to the product in the sealed interior space.

One issue with existing containers is the difficultly for a user to grasp or otherwise apply a force to the first end 101 of the tab 100. The tab 100 is normally a relative small piece that is mounted in close proximity to the top side 91 of the container 90. A user often has difficulty getting a portion of their finger under the first end 101 to apply the upward force necessary to pivot the tab 100 and move the punch-out 94 through the opening 97.

For a manufacturer who fills and seals the container, it is very difficult to address this issue after a flat tab is attached to the container. It is difficult to bend the flat tabs 100 that are mounted to the filled containers without unsealing the containers. The force necessary to bend the tabs causes the tabs to pivot thus pushing the second end against the punch-out and unsealing the opening.

Another issue that manufacturers have is bending the tab prior to affixing the container end to a remainder of the container. Many assembly lines are configured to handle container ends that include flat tabs. Bent tabs may cause feeding issues with the assembly line machinery resulting in poor quality and/or slower output.

SUMMARY

The present application is directed to devices and methods of bending a tab that is connected to a sealed container. The tab is bent without unsealing the contents of the container.

One embodiment is directed to a device for bending a tab that is attached to a sealed container. The device includes a brace with a contact surface at a first end and has an elongated axial length. The device also includes a contact member that is movable along the axial length of the brace. The contact member includes a circumferential tapered section. The device includes a support that is separate from each of the brace and the contact member and that extends around the brace. The device includes lever arms positioned around the brace that each includes an intermediate section that is pivotally attached to the support. Each of the lever arms includes a first end with an angled contact surface and an opposing second end with a bearing that contacts against the tapered section of the contact member. The first and second ends are on opposing sides of the intermediate section. The lever arms are each configured to pivot about the intermediate section during movement of the contact member along the axial length of the brace between a first position with the first ends spaced radially away from the first end of the brace and a second position with the first ends in closer proximity to the first end of the brace.

The contact member may include a central opening that receives the brace such that the contact member extends circumferentially around the brace.

The tapered section of the contact member may be at an axial end of the contact member.

The brace may include a narrower width at the first end than at a proximal section along the axial length away from the first end with the width measured perpendicular to an axis that extends along the axial length.

The lever arms may be separate from the brace and the contact member.

Each of the angled contact surfaces may include a variable width with a tip that is narrower than a foot section with the tip being in closer proximity to the brace than the foot section.

Each of the lever arms may include a biasing member to bias the second ends of the lever arms against the tapered section of the contact member.

Another embodiment is directed to a device for bending a tab that is attached to a sealed container. The device includes an elongated brace with a first end with a contact surface. A contact member is movable along a length of the brace with the contact member comprising a circumferential tapered section. A support extends around the brace. Lever arms are pivotally attached to the support and extend circumferentially around the brace. Each of the lever arms includes a pivot connection, a wedge on a first side of the pivot connection, and a bearing positioned on an opposing second side of the pivot connection. The device is movable between a first position with the contact member at a first axial location relative to the brace and each of the lever arms at a first pivot orientation with the bearings in contact with the tapered section and the wedges located radially away from the brace, and a second position with the contact member at a different second axial location relative to the brace and each of the lever arms at a second pivot orientation with the bearings in contact with a wider location along the tapered section and the wedges located radially in closer proximity to the brace.

The wedge may be positioned at a first end of each of the lever arms.

The contact member may extend around the brace.

The tapered section of the contact member may be at an axial end of the contact member.

The brace may include a narrower width at the first end than at a proximal section axially away from the first end.

Each of the wedges may include a tip that is narrower than a foot section.

Each of the lever arms may include a biasing member to bias a second end towards the tapered section.

The brace and the contact member may be coaxially aligned along a common axis.

Another embodiment is directed to a method of bending a tab that is attached to a sealed container. The method includes: contacting a brace against the tab with an end of the tab extending outward beyond the brace; positioning lever arms circumferentially around the brace and around the tab; while the brace is in contact with the tab, moving a tapered contact member axially along the brace and pivoting each of the plurality of lever arms with a first end of the lever arms moving radially inwardly towards the brace and a second end of the lever arms remaining in contact with the tapered contact member and moving radially outwardly away from the brace; moving at least one wedge positioned at the first end of each of the lever arms under the end of the tab that extends outward from the brace and bending the tab while the brace remains in contact against the tab.

The method may also include aligning the wedges at the first end of each of the lever arms axially with the end of the brace prior to moving the tapered contact member axially along the brace.

The method may also include biasing the first end of each of the arms radially away from the brace.

The method may also include sliding a bearing member at the second end of each of the arms along the tapered contact member while moving the at least one wedge under the end of the tab.

The method may also include moving the tapered contact member axially along the brace and sliding bearing members at the second ends of each of the arms from a first axial position along the tapered contact member that includes a smaller width to a second axial position along the tapered contact member that includes a greater width.

The various aspects of the various embodiments may be used alone or in any combination, as is desired.

DETAILED DESCRIPTION

The present application is directed to a device to bend a tab on a filled and sealed container. The device includes a brace for contacting against the tab and a number of lever arms that initially extend around the tab on multiple different sides. The lever arms are configured to move between a first orientation that are spaced away from the tab, and a second orientation in contact with the tab. The lever arms are further configured to apply a force to the end of the tab to bend a first end upward and away from a top side of the container. The device may further be configured to engage with and bend the tab when the container is positioned at various rotational positions relative to the device.

For purposes of this application, the device 10 will be described in the orientation illustrated in FIG. 2. This includes the device 10 vertically above the container 90. Further, the movements of the components are described relative to a centerline C of the container 90. This orientation is for ease of description in describing the relative positioning of the various components of the device 10 and the container 90. It is understood that the device 10 and container 90 may be positioned at a variety of different orientations and movable relative to different axes and within different planes. For further ease of explanation, the various components of the device 10 will include distal sections that are in closer proximity to the container 90 when the device 10 is engaged with the container 90, and opposing proximal sections that are farther from the container 90.

Figure 1:
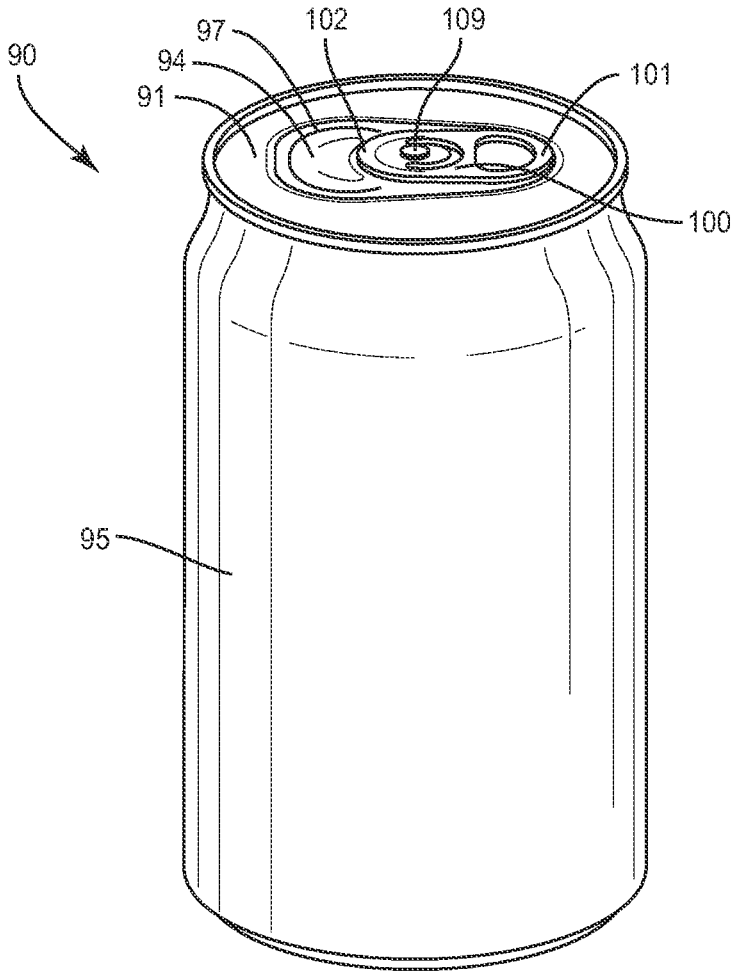
FIG. 1 is a perspective view of a container that includes a tab that extends across an opening on a top side.
Figure 2:
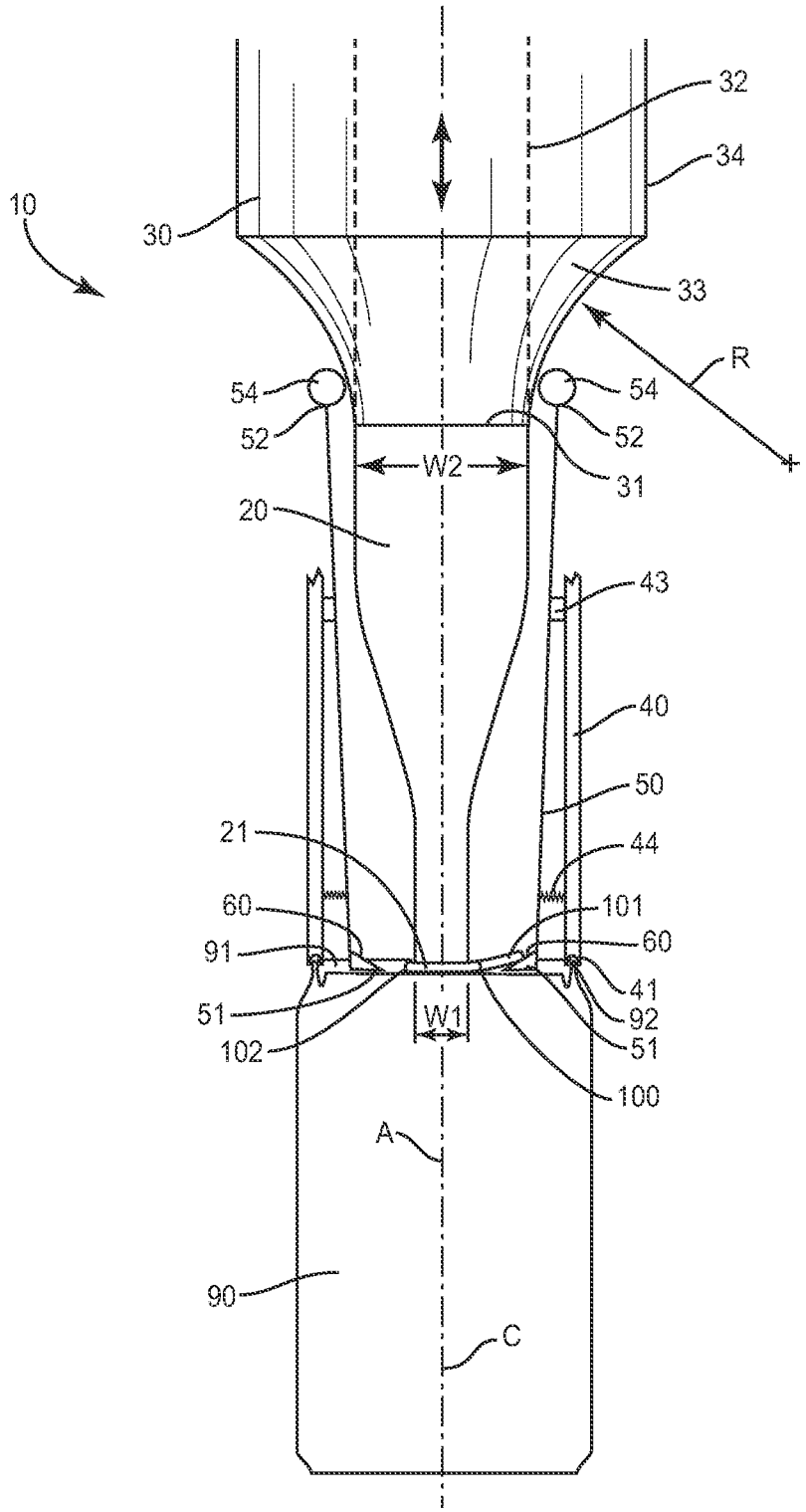
FIG. 2 is a side schematic view of a device to bend a tab with just two lever arms illustrated.

FIG. 2 includes the device 10 and container 90 each aligned along a common axis C. It should be understood that the device 10 may also be positioned at different alignments relative to the container 90.

FIG. 2 illustrates a device 10 positioned in contact with a container 90. The device 10 is aligned with the container 90 with a longitudinal axis of the device 90 and a longitudinal axis of the container 90 each being coaxial along axis C. The device 10 generally includes a central brace 20, a tapered sleeve 30, and a cylinder 40 that includes a number of lever arms 50. FIG. 2 includes just a pair of opposing lever arms 50, with a remainder removed to provide illustration of the brace 20 and tapered sleeve 30.

Each of the members 20, 30, 40, 50 is configured to move axially along the axis C. The lever arms 50 are further configured to move radially relative to the axis C to move under the tab 100 and apply a bending force to the first end 101 of the tab 100. FIG. 2 illustrates the first end 101 having already been bent by the device 100.

The brace 20 includes an elongated shape with a first end 21 that contacts against the tab 100. In one or more embodiments, the first end 21 includes a width W1 that is smaller than a width of the tab 100 measured between the first and second ends 101, 102. A width of the brace 20 may vary along its length. For example as illustrated in FIG. 2, the first end 101 includes a smaller width than proximal section farther along the length (i.e., farther away from the container 90). This smaller width at the distal section provides for clearance for the lever arms 50 to move radially to engage with the tab 100. In one or more embodiments, a section of the brace 20 includes a tapered shape with a width that increases towards the proximal section. A width of the proximal section may be constant to facilitate contact with the tapered sleeve 30.

The tapered sleeve 30 is configured to move axially along the brace 20. In one or more embodiments, the tapered sleeve 30 includes a cylindrical shape. The tapered sleeve 30 includes an inner opening 32 sized to receive the brace 20. The opening 32 is sized relative to the brace 20 such that the sleeve 30 can axially move along the brace 20. The sleeve 30 includes a first end 31, a tapered section 33 that increases in width away from the first end 31, and a proximal non-tapered section 34. In one or more embodiments, the tapered section 33 includes a bowed configuration that extends along a periphery of a curve with a radius R that extends from a center point P. In one or more embodiments, the tapered section 33 is flat (i.e., non-bowed). In one or more embodiments as illustrated in FIG. 2, the tapered section 34 begins at the first end 31 and extends proximally along a portion of the sleeve 30.

The cylinder 40 is positioned radially outward from and extends around the brace 20 when the device 10 is engaged with the container 90 as illustrated in FIG. 2. In one or more embodiments, the cylinder 40 includes a cylindrical shape. The cylinder 40 includes a first end 41 that contacts the container 90. The first end 41 may include an indent shaped and sized to receive a raised rim 92 that extends around the periphery of the top side 91 of the container 90. A collar 43 is attached to the cylinder 40 at a point away from the first end 41. The collar 43 provides a connection and pivot point for the lever arms 50. The collar 43 includes an annular shape with a central opening sized to receive the lever arms 50 and brace 20. In one or more embodiments, the collar 43 is attached along a radially inner side of the cylinder 40.

Biasing members 44 may extend between the cylinder 40 and the lever arms 50. In one or more embodiments, each biasing member 44 includes a first end connected to the cylinder 40 and a second end connected to one of the lever arms 50. In one or more embodiments, the biasing members 44 are connected to the cylinder 40 in closer proximity to the first end 41 than to the collar 43. The biasing members 44 apply a force to the lever arms 50 so the lever arms 50 do not remain in the closed position. In one embodiment, the biasing members 44 are springs. Other embodiments may include other structures, such as a flexible filament.

The lever arms 50 are positioned radially between the cylinder 40 and the brace 20 when the device 10 is engaged with the container 90 as illustrated in FIG. 2.

Figure 4:
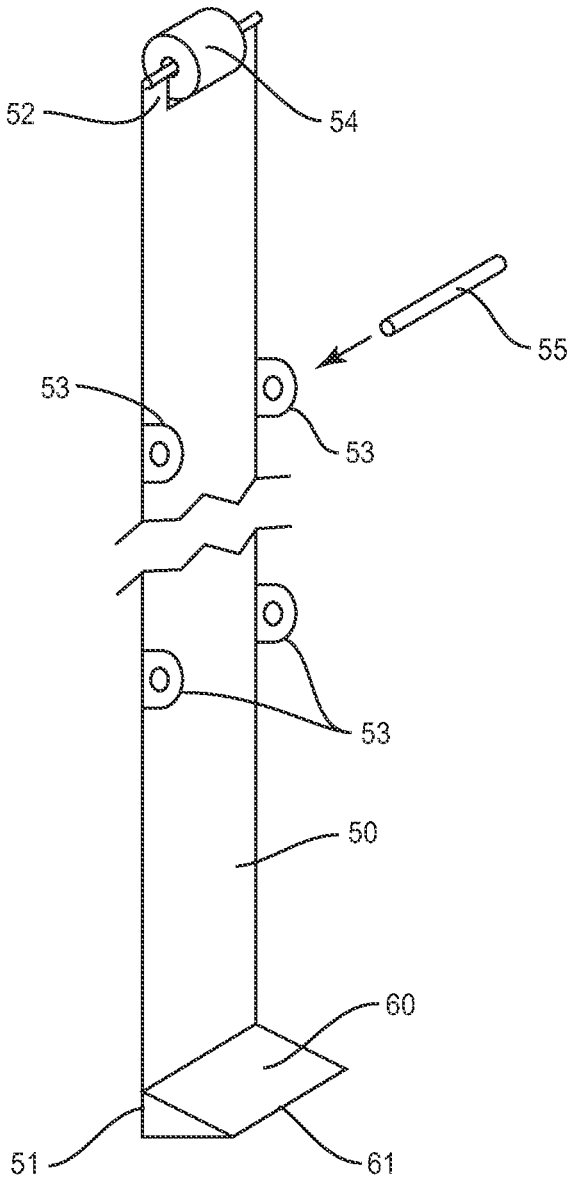
FIG. 4 is an exploded perspective view of a lever arm with a connector and a pin for attached to the cylinder.

The device 10 includes a number of lever arms 50 to extend around the circumference of the container 90. Each lever arm 50 includes an elongated shape with a first end 51 and a second end 52. An intermediate section of each lever arm 50 between the first and second ends 51, 52 is attached to the cylinder 40. As illustrated in FIG. 4, one or more connectors 53 may be positioned along the intermediate section for connecting with the collar 43. The connectors 53 may include openings sized to receive a pin 55. The pin 55 provides for pivotally attaching the lever arm 50 to the collar 43. Different connectors 53 may be positioned along the length of the intermediate section to adjust the pivot point of the lever arm 50. This adjustability applies for using lever arms 50 with different sized containers 90 and/or different types of devices 10.

A wedge member 60 is positioned at the first end 51 of each lever arm 50. The wedge members 60 include a narrow tip 61 that faces radially inward towards the axis C. The wedge 60 includes a tapered shape with an increasing thickness from the tip 61 towards the lever arm 50. In one or more embodiments, the tip 61 includes an acute angle.

Figure 5A:
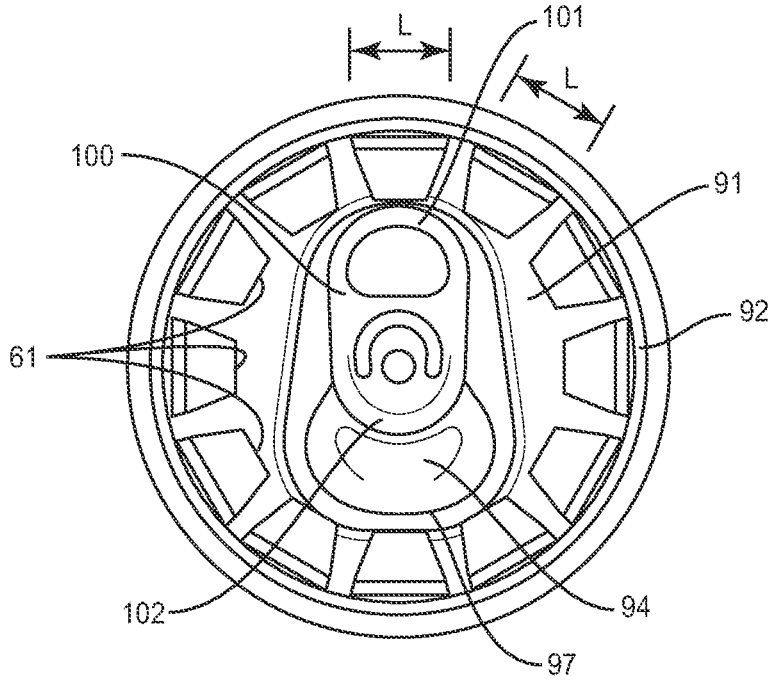
FIG. 5A is a top view of wedges aligned along a top side of a container when the device is in an open orientation.
Figure 5B:
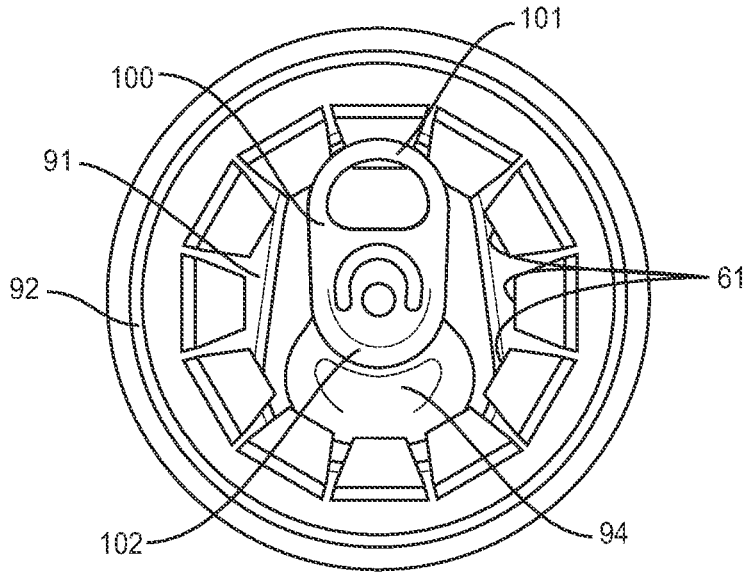
FIG. 5B is a top view of wedges aligned along a top side of a container when the device is in a closed orientation.

FIGS. 5A and 5B illustrate top views of the wedge members 60 in an open orientation (FIG. 5A) and a closed orientation (FIG. 5B). When the device 10 is engaged with the container 90, the lever arms 50 extend around the top surface 91 of the container 90 and surround the tab 100 from different angular directions. In one or more embodiments, each wedge member 60 includes a tapered shape that decreases in size L from a foot section towards the tip 61. The tapered length provides for the lateral spacing between adjacent wedge members 60 when the lever arms 50 are in the open orientation as illustrated in FIG. 5A. The tapered length provides for the adjacent wedge members 60 to move together and into contact when the lever arms 50 are in the closed orientation as illustrated in FIG. 5B.

Figure 3:
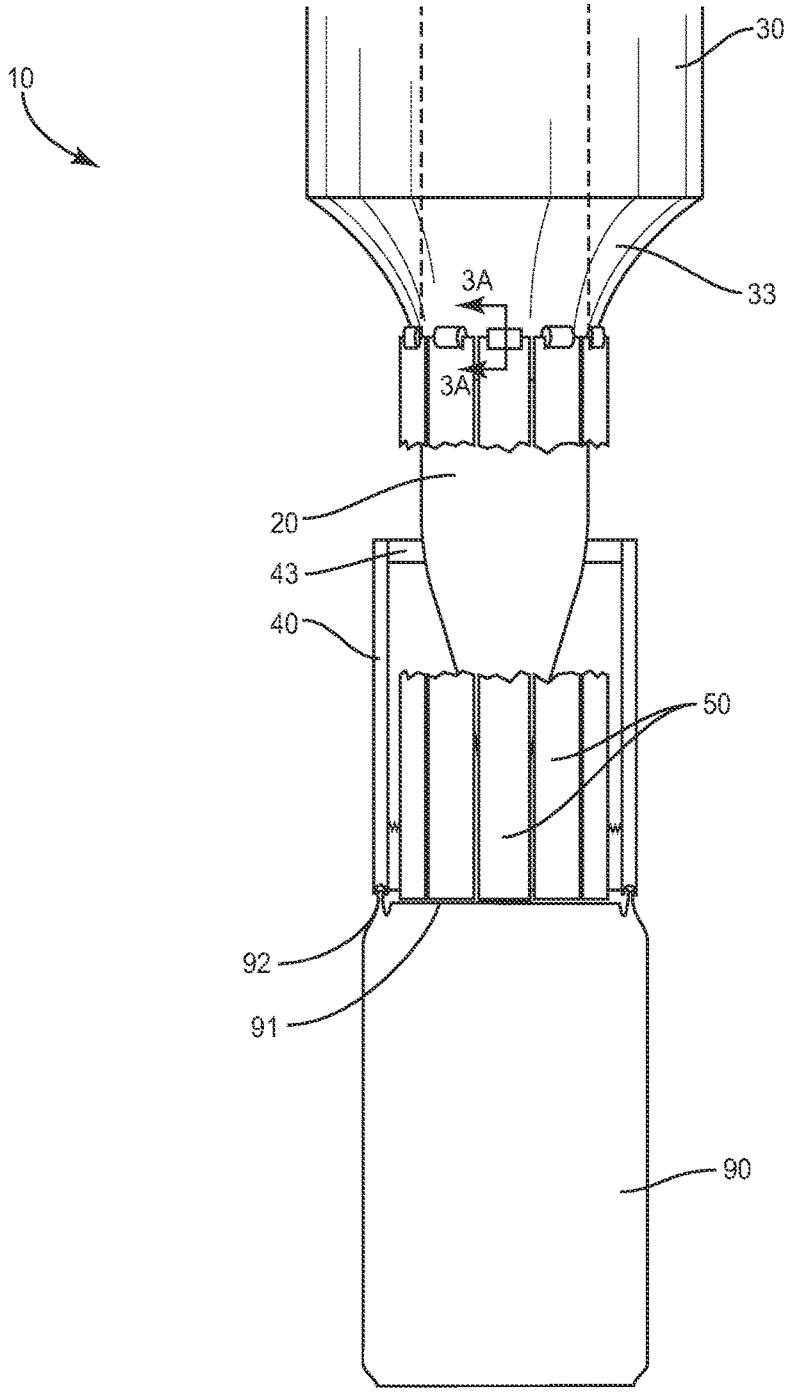
FIG. 3 is a side view of the device with an intermediate section of each lever arm cut-away to provide a view into the interior of the device.
Figure 3A:
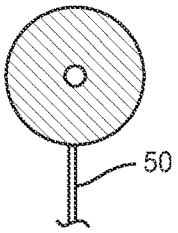
FIG. 3A is a section view of a bearing member cut along line III-III of FIG. 3.

The levers arms 50 also include a bearing member 54 at the second end 52. Each bearing member 54 is configured to move axially along the tapered section 33 of the sleeve 30 when the lever arms 50 move between the open and closed orientations. The bearing member 54 may be shaped to facilitate sliding movement along the tapered section. In one or more embodiments as illustrated in FIGS. 3A and 4, the bearing member 54 includes a curved exterior surface that contacts against the tapered section 33. In one or more specific embodiments, the bearing member 54 includes a circular cross-sectional shape. The bearing members 54 remain in contact with the tapered section 33 during movement of the tapered sleeve 30.

FIGS. 6-9 illustrate one embodiment of the device 10 in use to bend the tab 100. Initially, the device 10 is aligned with the container 90. In one or more embodiments, the device 10 is aligned with a longitudinal axis of the device 10 aligned with the longitudinal axis of the container 90. One or more other embodiments may include the longitudinal axes offset from one another. For ease of viewing, FIGS. 6-10 illustrate a single lever arm 50. It is understood that a plurality of lever arms 50 are included with the device 10 and extend around the device to surround the tab 100 as discussed above.

The device 10 is brought into contact with the container 90. This may include the device 10 being moved into contact with the stationary container 100, the container 90 being brought into contact with the stationary device 10, or simultaneous movement of both the container 90 and device 100.

Figure 6:
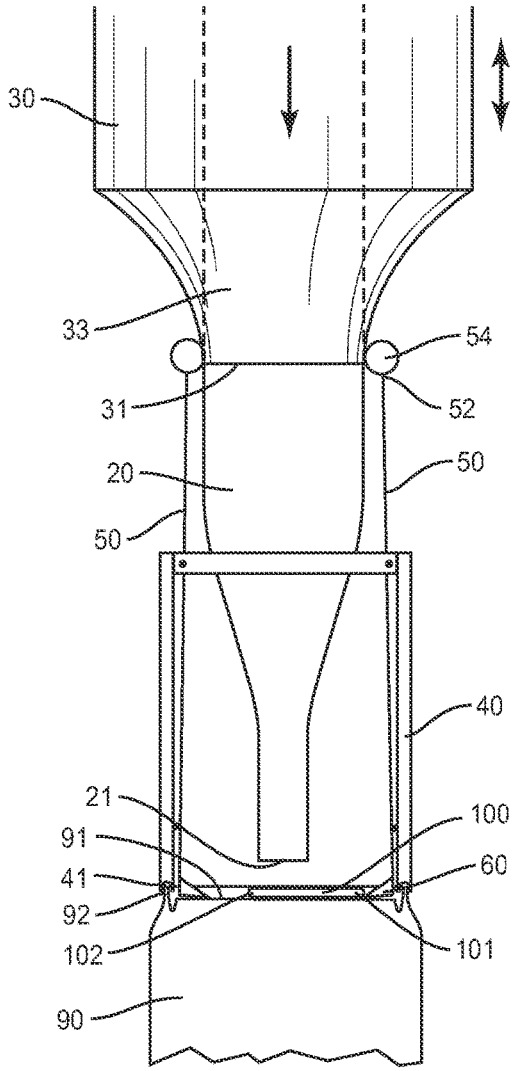
FIG. 6 is a side view of a device with just a single lever arm illustrated with the device in a first position during use.

In one or more embodiments as illustrated in FIG. 6, the cylinder 40 is initially contacted against the container 90. This may include the first end 41 of the cylinder 40 contacting against the peripheral rim 92 of the container 90. In one or more embodiments, the cylinder 40 includes a circular sectional shape to contact the container 90 around its periphery. As illustrated in FIG. 6, when the cylinder 40 is in contact with the container 90, the brace 20 is in a retracted positioned with the first end 21 spaced away from the top side 91 of the container 90. The tapered sleeve 30 is also in a retracted position.

In this initial position, the levers arms 55 are each positioned with the bearing members 54 at the second end 52 contacting against a first portion of the tapered section 33 in proximity to the first end 31. This also positions the first ends 51 and wedges 60 in proximity to the cylinder 40. In one or more embodiments as illustrated in FIG. 6, the lever arms 50 are substantially parallel with the longitudinal axis of the device 10. This positioning of the lever arms 50 spaces the wedges 60 away from the tab 100 (see FIG. 5A). The bearing members 54 may move along different lengths of the tapered section 33 depending upon the size of the container 90.

Figure 7:
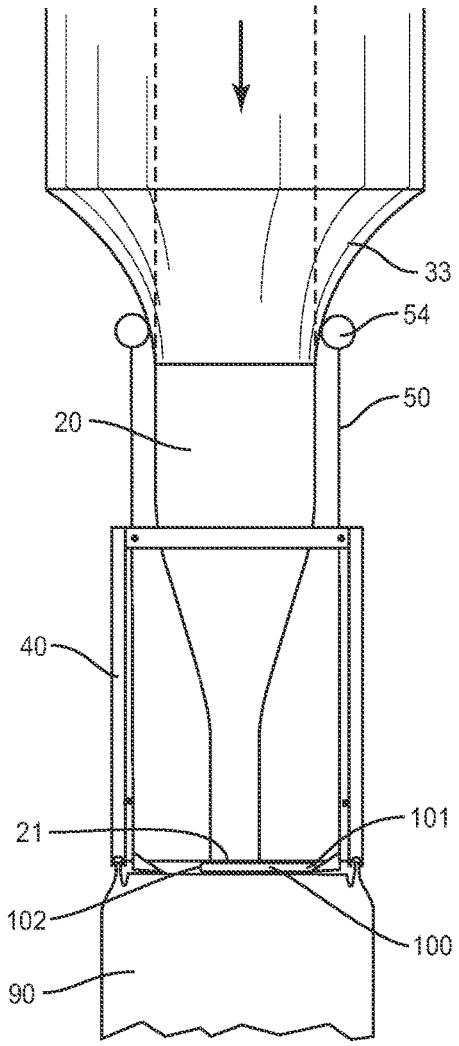
FIG. 7 is a side view of a device with just a single lever arm illustrated with the device in a second position during use.

As illustrated in FIG. 7, the brace 20 is then moved downward and brought into contact with the tab 100. In one or more embodiments, the brace 20 pins the tab against the top side 91 of the container 90. The first end 21 is positioned to contact the tab 100 with the first end 101 of the tab 100 positioned laterally outward beyond the first end 21 of the brace 20. In one or more embodiments, the tapered sleeve 30 remains stationary during the movement of the brace 20 such that the lever arms 50 remain at the same relative position. In one or more embodiments, the container 90 is already filled and the interior space is under pressure at the time the device 10 initially makes contact. This provides for the container 90 to be more rigid thus providing a firm base for contact with the device 10.

Figure 8:
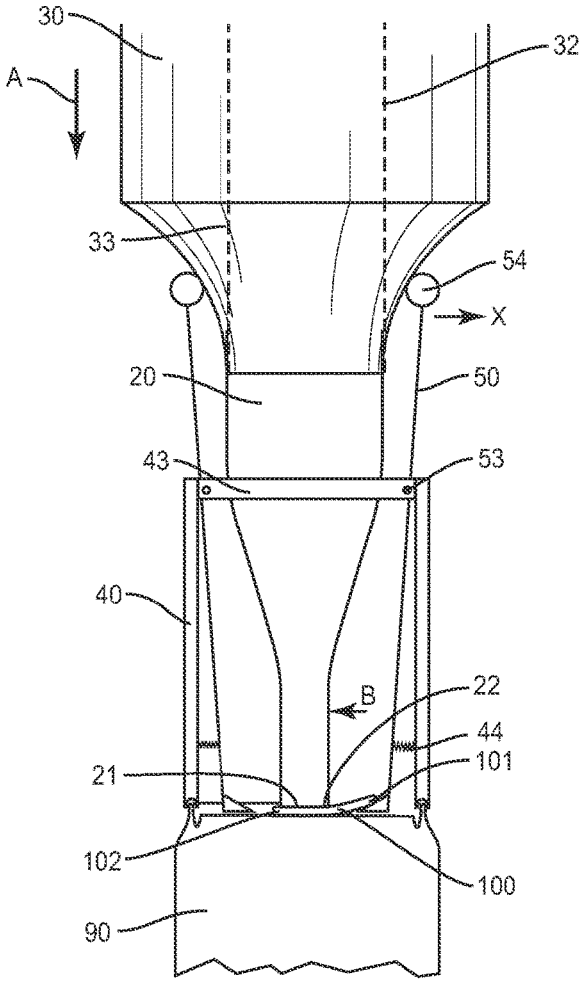
FIG. 8 is a side view of a device with just a single lever arm illustrated with the device in a third position during use.
Figure 9:
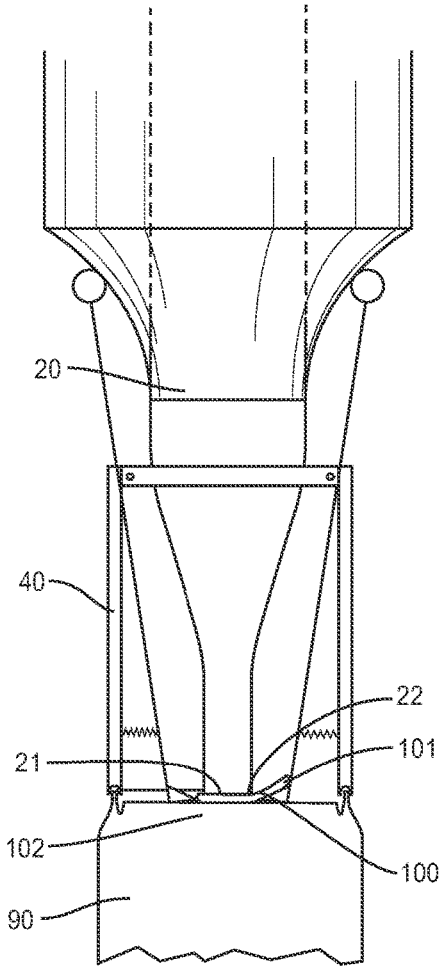
FIG. 9 is a side view of a device with just a single lever arm illustrated with the device in a fourth position during use.

As illustrated in FIG. 8, after the brace 20 is positioned against the tab 100, the tapered sleeve 30 is then moved axially in the direction of arrow A downward relative to and along the brace 20. This movement causes the lever arms 50 to pivot about the connectors 53 with the collar 43. This pivoting movement is caused by the bearing members 54 at the second ends 52 of the lever arms 50 riding along the tapered section 33 of the sleeve 30. The tapered shape causes the bearing members 54 and second ends 52 to move radially outward from the brace 20 in the direction indicated by arrow X while the wedges 60 and first ends 51 move laterally inward in the direction indicated by arrow B. The force applied by the tapered sleeve 30 to the lever arms 50 is greater than the biasing force applied by the biasing members 44 thus providing for the pivoting movement of the lever arms 50 about the connectors 53 on the collar 43. As illustrated in FIG. 9, additional relative movement of the tapered sleeve 30 along the brace 20 causes additional pivoting movement of the lever arms 50.

Figure 10:
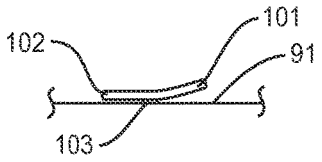
FIG. 10 is a side view of a tab that has been bent by the device while attached to a top side of a sealed container.

As illustrated in FIG. 5B, the wedges 60 at the first ends 51 of the lever arms 50 move radially inward relative to the container 90. This movement causes one or more of the wedges 60 to move under the first end 101 of the tab 100. The force of the one or more wedges 60 contacting against and moving under the first end 101 applies a bending force to the tab 100. In one or more embodiments, the force applied by the one or more wedges 60 causes a bending force to be applied to the tab 100 along a line formed by a bending edge 22 at the first end 21 of the brace 20. As illustrated in FIG. 10, the bend 103 positions the first end 101 farther away from the top side 91 of the container 90 to facilitate the user grasping and/or getting their finger under the tab 100 to unseal the container 90.

Removal of the device 10 from the container 90 includes movement of the various components in a reverse order. From the closed orientation as illustrated in FIG. 9, the tapered sleeve 30 is moved upward relative to the brace 20 (i.e., away from the container 90). This movement causes the second ends 52 and bearing members 54 to slide along the tapered section 33 of the sleeve 30. This movement pivots the lever arms 50 about the connectors 53 with the first ends 51 and wedges 60 moving back towards the cylinder 40. This movement is facilitated by the biasing force of the biasing members 44 that apply a returning force in this direction to the lever arms 50. Once the lever arms 50 have moved away from the tab 100, the brace 20 and cylinder 40 may be moved axially away from the container 90.

The device 10 provides for bending the tab 100 without causing the container 90 to become unsealed. The force applied to the tab 100 by the one or more wedge members 60 is prevented from causing the second end 102 of the tab 100 to press downward onto the punch-out 94 by the contact and positioning of the brace 20. The force results in the first end 101 bending around the bend corner 22 of the brace 20.

The placement of the wedge members 60 around the perimeter of the container 90 accommodates the container 90 at various rotational positions relative to the device 10. One or more of the wedges 60 will move under the tab 100 regardless of the rotational position. Therefore, there is no need to align the container 90 to a particular rotational orientation relative to the device 10 prior to starting the process.

Figure 11:
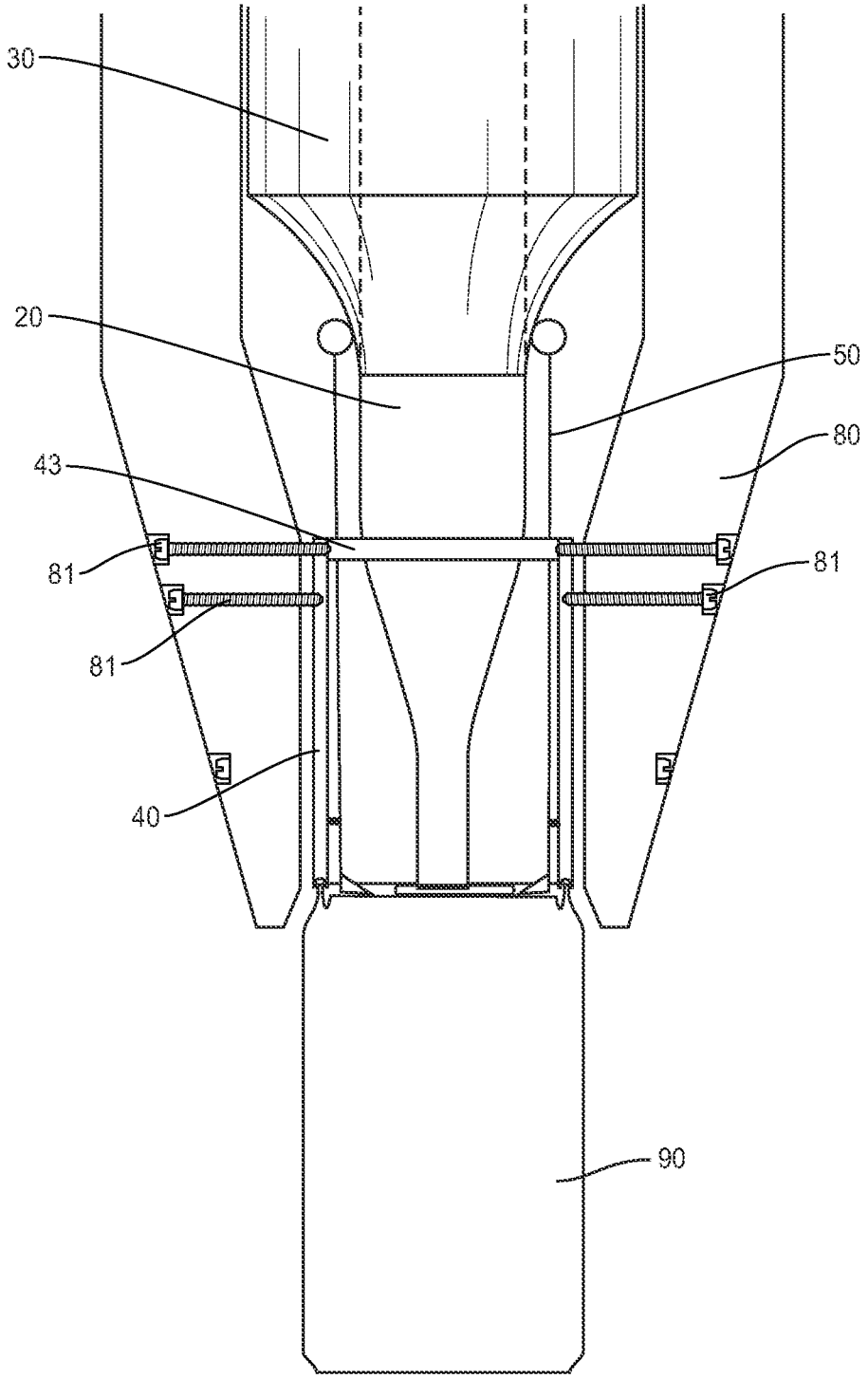

In one or more embodiments as illustrated in FIG. 11, a support member 80 extends around the cylinder 40. The support member 80 is attached to and supports the cylinder 40. One or more fasteners 81 may connect the outer member 80 to the cylinder 40.

The brace 20, tapered sleeve 30, and cylinder 40 may be axially moved in the different directions through a variety of different manners. In one or more embodiments, one or more of the components are powered through one or more motors. In one or more other embodiments, one or more of these components are moved by manual force that is applied by the operator.

The device 10 may be used in a variety of different environments. In one or more embodiments, the device 10 is used in a canning line of a facility. Prior to reaching the device, the container 10 is sealed or seamed by the process of affixing a metal container end that includes the top side 91 and tab 100 to a container body that includes the side wall 95. The device 10 may be implemented directly into the canning line of the facility.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive.

What is claimed is:

1. A device for bending a tab that is attached to a sealed container, the device comprising:

a brace with a contact surface at a first end, the brace including an elongated axial length;

a contact member that is movable along the axial length of the brace, the contact member comprising a circumferential tapered section;

a support that is separate from each of the brace and the contact member and that extends around the brace;

lever arms that are positioned around the brace that each includes an intermediate section that is pivotally attached to the support, each of the lever arms including a first end with an angled contact surface and an opposing second end with a bearing that contacts against the tapered section of the contact member, the first and second ends being on opposing sides of the intermediate section;

the lever arms each configured to pivot about the intermediate section during movement of the contact member along the axial length of the brace between a first position with the first ends spaced radially away from the first end of the brace when the contact member is positioned along the axial length of the brace a first distance from the first end of the brace and a second position with the first ends in closer radial proximity to the first end of the brace when the contact member is positioned along the axial length of the brace a second closer distance from the first end of the brace.

2. The device of claim 1, wherein the contact member includes a central opening that receives the brace such that the contact member extends circumferentially around the brace.

3. The device of claim 1, wherein the tapered section of the contact member is at an axial end of the contact member.

4. The device of claim 1, wherein the brace includes a narrower width at the first end than at a proximal section along the axial length away from the first end, the width measured perpendicular to an axis that extends along the axial length.

5. The device of claim 1, wherein the lever arms are separate from the brace and the contact member.

6. The device of claim 1, wherein each of the angled contact surfaces includes a variable width with a tip that is narrower than a foot section, the tip being in closer proximity to the brace than the foot section.

7. The device of claim 1, wherein each of the lever arms includes a biasing member to bias the second ends of the lever arms against the tapered section of the contact member.

8. A device for bending a tab that is, attached to a sealed container, the device comprising:

an elongated brace with a first end with a contact surface;

a contact member that is movable along a length of the brace, the contact member comprising a circumferential tapered section;

a support that extends around the brace;

lever arms that are pivotally attached to the support and that extend circumferentially around the brace, each of the lever arms including a pivot connection, a wedge on a first side of the pivot connection, and a bearing positioned on an opposing second side of the pivot connection;

the device being movable between a first position with the contact member at a first axial location relative to the brace and each of the lever arms at a first pivot orientation with the bearings in contact with the tapered section and the wedges located radially away from the brace, and a second position with the contact member at a different second axial location relative to the brace and each of the lever arms at a second pivot orientation with the bearings in contact with a wider location along the tapered section and the wedges located radially in closer proximity to the brace;

wherein the contact member extends around the brace.

9. The device of claim 8, wherein the wedge is positioned at a first end of each of the lever arms.

10. The device of claim 1, wherein the tapered section of the contact member is at an axial end of the contact member.

11. The device of claim 8, wherein the brace includes a narrower width at the first end than at a proximal section axially away from the first end.

12. The device of claim 8, wherein each of the wedges includes a tip that is narrower than a foot section.

13. The device of claim 8, wherein each of the lever arms includes a biasing member to bias a second end towards the tapered section.

14. The device of claim 8, wherein the brace and the contact member are coaxially aligned along a common axis.

* * * * *